US009799994B2

(12) United States Patent
Chen

(10) Patent No.: US 9,799,994 B2
(45) Date of Patent: Oct. 24, 2017

(54) HIGH SPEED SOCKET CONNECTOR

(71) Applicant: Oupiin Electronic (Kunshan) Co., LTD, Jiangsu Province (CN)

(72) Inventor: Hsin Chih Chen, Jiangsu Province (CN)

(73) Assignee: Oupiin Electronic (Kunshan) Co., LTD, Jiangsu Province (CN)

( * ) Notice: Subject to any disclaimer, the term of this patent is extended or adjusted under 35 U.S.C. 154(b) by 0 days.

(21) Appl. No.: 15/291,906

(22) Filed: Oct. 12, 2016

(65) Prior Publication Data

US 2017/0179651 A1 Jun. 22, 2017

(30) Foreign Application Priority Data

Dec. 22, 2015 (CN) ..... 2015 1 0966198

(51) Int. Cl.

| | |
|---|---|
| ***H01R 13/6585*** | (2011.01) |
| ***H01R 24/76*** | (2011.01) |
| ***H01R 12/77*** | (2011.01) |
| ***H01R 13/6471*** | (2011.01) |
| *H01R 107/00* | (2006.01) |

(52) U.S. Cl.

CPC ..... *H01R 13/6585* (2013.01); *H01R 12/775* (2013.01); *H01R 13/6471* (2013.01); *H01R 24/76* (2013.01); *H01R 2107/00* (2013.01)

(58) Field of Classification Search

CPC ..... H01R 13/6585
USPC ..... 439/607.05
See application file for complete search history.

(56) References Cited

U.S. PATENT DOCUMENTS 5,403,204 A * 4/1995 Chishima ..... H01R 13/4223 439/189
5,496,188 A * 3/1996 Okamura ..... H01R 31/08 439/189
5,749,753 A * 5/1998 Chishima ..... H01R 13/113 439/752.5
5,888,096 A * 3/1999 Soes ..... H01R 13/112 439/252
5,938,456 A * 8/1999 Kozel ..... H01R 13/41 439/733.1
6,109,935 A * 8/2000 Yang ..... H01R 12/725 439/80

(Continued)

*Primary Examiner* — Tulsidas C Patel
*Assistant Examiner* — Peter G Leigh
(74) *Attorney, Agent, or Firm* — WPAT, P.C., Intellectual Property Attorneys; Anthony King

(57) ABSTRACT

A high speed socket connector is disclosed in this invention, including a case, a terminal mold, an upper shield and a lower shield. The terminal mold includes an insulative body, a row of upper terminals and a row of lower terminals. The insulative body forms multiple first openings and second openings. The upper terminals and the lower terminals both include multiple differential pairs of signal terminals and multiple grounding terminals. Each signal terminal has a serpentine retaining section exposed in the corresponding first opening. Each grounding terminal has a straight retaining section exposed in the corresponding second opening. The upper shield and the lower shield are respectively mounted on the top and the bottom of the terminal mold. The high speed socket connector can realize a good shielding effect by the connection of the upper and lower shields and the grounding terminals.

9 Claims, 10 Drawing Sheets

1

(56) References Cited

U.S. PATENT DOCUMENTS 6,203,335 B1 * 3/2001 Chang ..... H01R 12/716 439/289
6,840,809 B2 * 1/2005 Wu ..... H01R 12/7011 439/636
6,926,542 B2 * 8/2005 Li ..... H01R 12/724 439/79
7,578,700 B2 * 8/2009 Xiong ..... H01R 13/65802 439/606
8,079,874 B2 * 12/2011 Lee ..... H01R 13/62 439/607.32
8,246,387 B2 * 8/2012 Fjelstad ..... H01R 13/05 439/638
8,506,332 B2 * 8/2013 Sommers ..... H01R 12/707 439/607.32
8,851,930 B2 * 10/2014 Peng ..... H05K 1/0248 439/660
9,136,645 B1 * 9/2015 Yu ..... H01R 12/7088
9,142,920 B2 * 9/2015 Oyake ..... H01R 13/6467
9,270,045 B2 * 2/2016 Kimura ..... H01R 13/41
2003/0236021 A1 * 12/2003 Waddell ..... H01R 24/60 439/465
2007/0269996 A1 * 11/2007 Chia ..... H01R 13/6471 439/66
2009/0053913 A1 * 2/2009 Chen ..... H01R 12/57 439/81
2010/0178794 A1 * 7/2010 Hsu ..... H01R 9/031 439/391
2011/0201215 A1 * 8/2011 Matsubara ..... H01R 13/6597 439/55
2012/0184145 A1 * 7/2012 Zeng ..... H01R 13/6585 439/626
2013/0237093 A1 * 9/2013 Kamarauskas .... H01R 13/2442 439/607.58
2013/0316581 A1 * 11/2013 Kao ..... H01R 13/6471 439/607.28
2013/0323978 A1 * 12/2013 Ho ..... H01R 13/04 439/626
2013/0323979 A1 * 12/2013 Ida ..... H01R 13/40 439/626
2013/0344739 A1 * 12/2013 Shih ..... H01R 13/658 439/607.28
2015/0044886 A1 * 2/2015 Little ..... H01R 12/75 439/55
2015/0072546 A1 * 3/2015 Li ..... H01R 13/6585 439/96
2015/0087165 A1 * 3/2015 Yu ..... H01R 12/724 439/78
2015/0171561 A1 * 6/2015 Little ..... H01R 24/60 439/607.34
2015/0171574 A1 * 6/2015 Little ..... H01R 24/60 439/78
2015/0194768 A1 * 7/2015 Little ..... H01R 13/6594 439/607.37
2015/0194772 A1 * 7/2015 Little ..... H01R 13/6597 439/357
2015/0207280 A1 * 7/2015 Little ..... H01R 24/60 439/607.34
2015/0244117 A1 * 8/2015 Kawamura ..... H01R 24/60 439/676
2015/0263465 A1 * 9/2015 Zhang ..... H01R 24/60 439/676
2015/0270646 A1 * 9/2015 Kao ..... H01R 13/6581 439/76.1
2015/0270659 A1 * 9/2015 Kao ..... H01R 24/64 439/607.01
2015/0303623 A1 * 10/2015 Kao ..... H01R 13/6583 439/607.04
2015/0303629 A1 * 10/2015 MacDougall ..... H01R 13/6581 439/607.01
2015/0318646 A1 * 11/2015 Little ..... H01R 4/023 439/78
2015/0333451 A1 * 11/2015 Kao ..... H01R 24/60 439/607.01
2015/0340791 A1 * 11/2015 Kao ..... H01R 24/60 439/676

* cited by examiner

HIGH SPEED SOCKET CONNECTOR

BACKGROUND OF THE INVENTION

1. Field of the Invention

The present invention relates to a connector, and more particularly to a high speed socket connector.

2. Description of the Prior Art

Development trend of connectors is high speed, high density, low crosstalk, low impedance, zero delay, etc. A high speed connector can help user achieve the high performance connectivity. But the biggest technical difficulty of the high speed connector is how to ensure the integrity of the signal and reduce the electromagnetic interference in the high speed transmission. As is well known, the electromagnetic interference exists mainly in two ways: radiated electromagnetic interference and conductive electromagnetic interference. For the radiated electromagnetic interference, it can be shielded in a shielded way. For the conductive electromagnetic interference, filtering is the most effective means of protection. Therefore, the high speed connector with shielding and filtering function can meet the electromagnetic compatibility of electronic products.

Hence, it is needed to provide a high speed socket connector with shielding and filtering function.

BRIEF SUMMARY OF THE INVENTION

An object of the present invention is to provide a high speed socket connector, which has the characteristics of shielding, improving the coupling performance of differential pair signal terminals, regulating the impedance and filtering.

Other objects and advantages of the present invention may be further understood from the technical features disclosed by the present invention.

To achieve the aforementioned object or other objects of the present invention, the present invention adopts the following technical solution.

The present invention provides a high speed socket connector, which comprises a case, a terminal module, an upper shield and a lower shield. The case has an insertion port located on the front of the case, and a mounting port located on the rear of the case and being opposite to the insertion port. The terminal module is mounted into the case from the insertion port. The terminal module includes an insulative body, a row of upper terminals formed on the insulative body, and a row of lower terminals formed on the insulative body. The insulative body forms multiple first openings and multiple second openings. Each of the upper and lower terminals has a mating section extending out of the front of the insulative body and entering into the insertion port, a welding section extending out of the rear of the insulative body and being exposed outside of the mounting port, and a retaining section located in the insulative body. These upper and lower terminals include multiple differential pairs of signal terminals and multiple grounding terminals adjacent to these signal terminals. The retaining section of each signal terminal is disposed to be a serpentine shape and exposed in the corresponding first opening; and the retaining section of each grounding terminal is disposed to be a straight shape and exposed in the corresponding second opening. The upper shield is mounted on the top of the terminal mould. The lower shield is mounted on the bottom of the terminal mould.

In one embodiment, the width of the serpentine retaining section of the signal terminal is equal to that of the straight retaining section of the grounding terminal; and the serpentine retaining section has multiple triangular teeth formed on two edges of the retaining section.

In one embodiment, each of the upper and lower shields has a thin plate-like main body and multiple elastic fingers formed on the main body and bent toward the terminal mould. The front of the main body of the upper shield extends above the mating sections of these upper terminals to cover the row of upper terminals, and each elastic finger of the upper shield enters into the corresponding second opening and contacts with the corresponding grounding terminals of the row of upper terminals to form a grounding connection. The front of the main body of the lower shield extends under the mating sections of these lower terminals to cover the row of lower terminals, and each elastic finger of the lower shield enters into the corresponding second opening and contacts with the corresponding grounding terminals of the row of lower terminals to form a grounding connection.

In one embodiment, the terminal module is provided with two positioning protrusions respectively formed on the top and the bottom of the terminal module; each of the upper and lower shields is provided with a positioning hole on the main body to be engaged with the corresponding positioning protrusion.

In one embodiment, the case further has two fixing holes symmetrically formed on the top of the mounting port, two holding grooves symmetrically formed on the bottom of the mounting port and being respectively aligned with the two fixing holes, and two shoulders symmetrically formed on the rear of the mounting port. The terminal module disposes two upright fixing posts and two fixing arms adjacent to the two fixing posts; the top of each fixing post is inserted into the corresponding fixing hole, the bottom of each fixing post is held by the corresponding holding groove, and the bottom of each fixing arm stands on the corresponding shoulder.

In one embodiment, the terminal module includes an upper module, a lower module and a holder; the upper module includes an upper insulative body, and these upper terminals are formed on the upper insulative body; the lower module includes a lower insulative body, and these lower terminals are formed on the upper insulative body; the two fixing posts and the two fixing arms are formed on the holder; and the insulative body consists of the upper insulative body, the lower insulative body and the holder.

In one embodiment, the upper module has a protruding block on the bottom of the upper module, and the lower module has a recess on the top of the lower module; the upper module and the lower module is initially positioned together by the engaging of the protruding block and the recess.

In one embodiment, a case further has a plurality of upper terminal-receiving passages formed on the top of the insertion port, and a plurality of lower terminal-receiving passages formed on the bottom of the insertion port; these upper and lower terminals respectively enter into the corresponding upper and lower terminal-receiving passages.

The present invention also provides a high speed socket connector, which comprises a case, a terminal module, an upper shield and a lower shield. The case has an insertion port located on the front of the case, and a mounting port located on the rear of the case and being opposite to the insertion port. The terminal module is mounted into the case from the insertion port and includes an insulative body, a row of upper terminals formed on the insulative body, and a row of lower terminals formed on the insulative body. The insulative body forms multiple first openings and multiple second openings. Each of the upper and lower terminals has a mating section extending out of the front of the insulative body and entering into the insertion port, a welding section extending out of the rear of the insulative body and being exposed outside of the mounting port, and a retaining section located in the insulative body. These upper and lower terminals include multiple differential pairs of signal terminals and multiple grounding terminals adjacent to these signal terminals. The retaining section of each signal terminal is exposed in the corresponding first opening; and the retaining section of each grounding terminal is exposed in the corresponding second opening. The upper shield is mounted on the top of the terminal mould. The lower shield is mounted on the bottom of the terminal mould. Wherein each of the upper and lower shields has a thin plate-like main body and multiple elastic fingers formed on the main body and bent toward the terminal mould. The front of the main body of the upper shield extends above the mating sections of these upper terminals to cover the row of upper terminals, and each elastic finger of the upper shield enters into the corresponding second opening and contacts with the corresponding grounding terminals of the row of upper terminals to form a grounding connection. The front of the main body of the lower shield extends under the mating sections of these lower terminals to cover the row of lower terminals, and each elastic finger of the lower shield enters into the corresponding second opening and contacts with the corresponding grounding terminals of the row of lower terminals to form a grounding connection.

In one embodiment, the retaining section of each signal terminal is disposed to be a serpentine shape or a square saw-tooth shape.

In comparison with the prior art, the high speed socket connector of the present invention can realize a good shielding effect by the connection of the upper and lower shields and the grounding terminals. The insulative body is provided with the first openings for exposing the retaining sections of the differential pair of signal terminals, thereby balancing the coupling performance of these differential pairs of signal terminals. Furthermore, the retaining sections of these differential pairs of signal terminals are disposed to be a serpentine shape for achieving the adjustment of the impedance and filtering effect.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "up", "down", "front", "back", "left", "right", "top", "bottom" etc., are only used with reference to the orientation of the accompanying drawings. Therefore, the used directional terms are intended to illustrate, but not to limit, the present invention.

Figure 1:
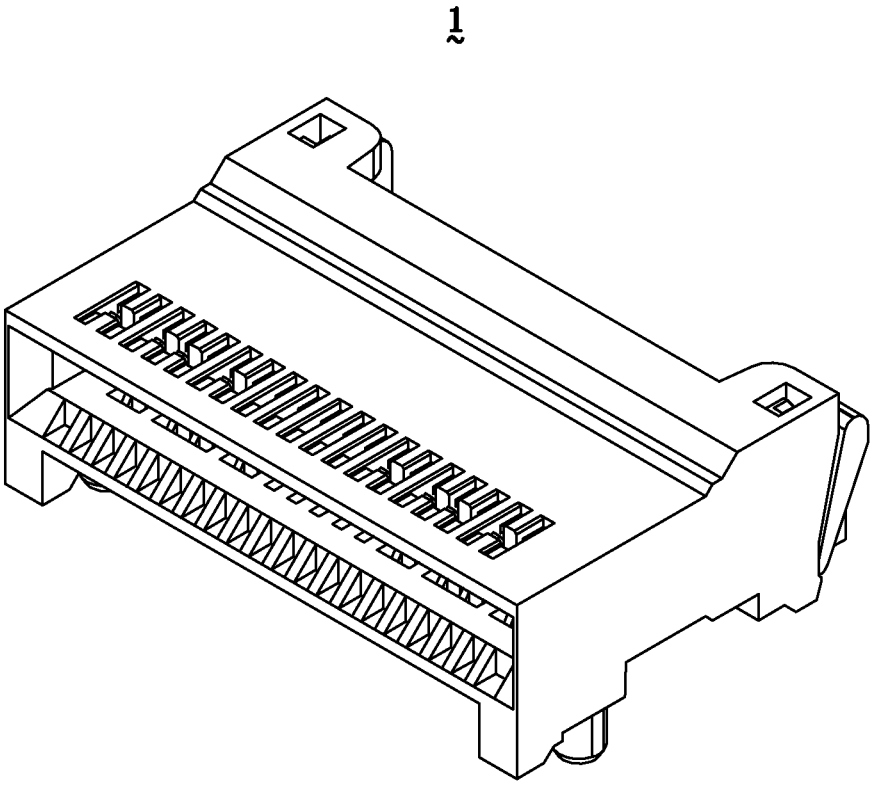
FIG. 1 is a perspective schematic view of a high speed socket connector of the present invention.
Figure 2:
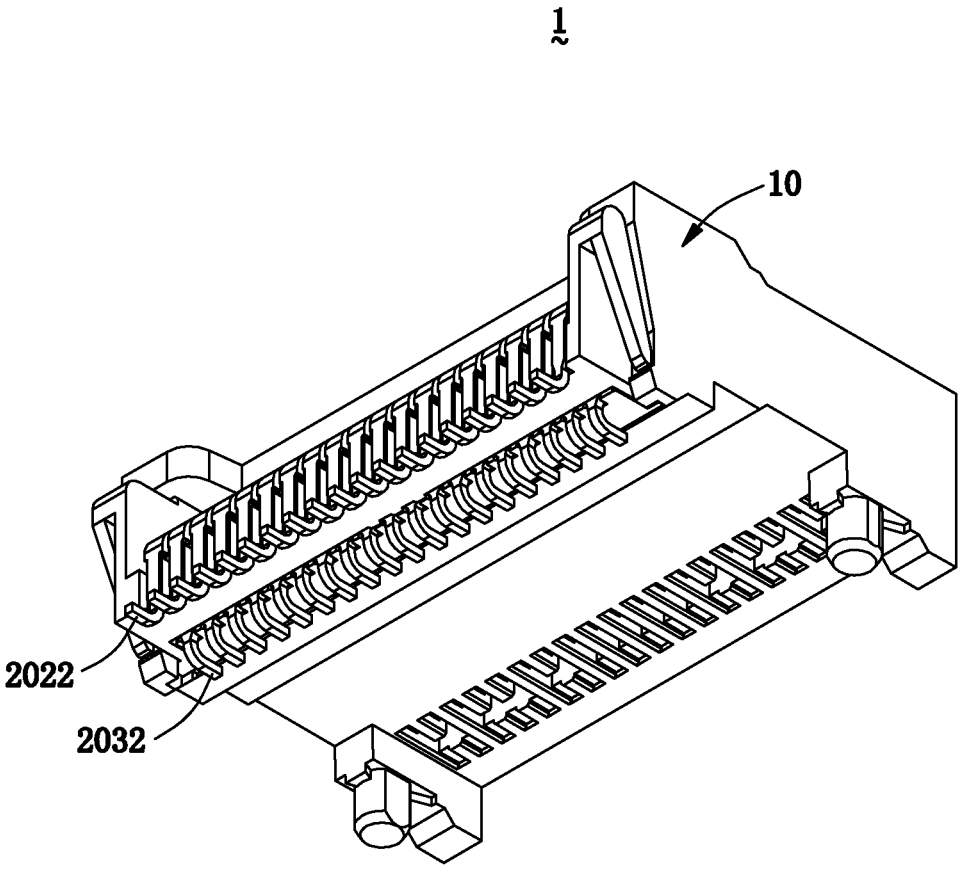
FIG. 2 is a perspective schematic view of the high speed socket connector along another direction.
Figure 3:
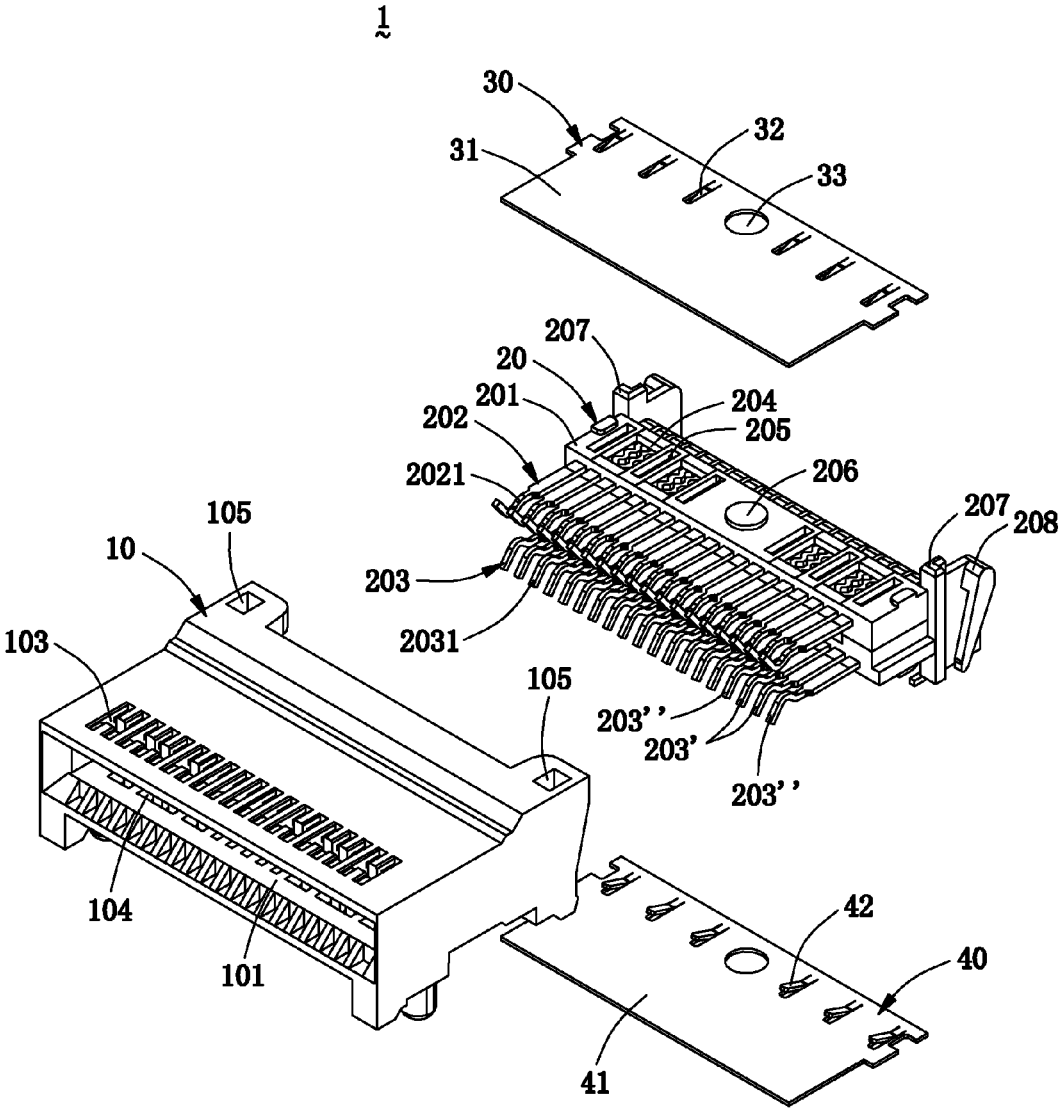
FIG. 3 is an exploded view of the high speed socket connector shown in FIG. 1.
Figure 4:
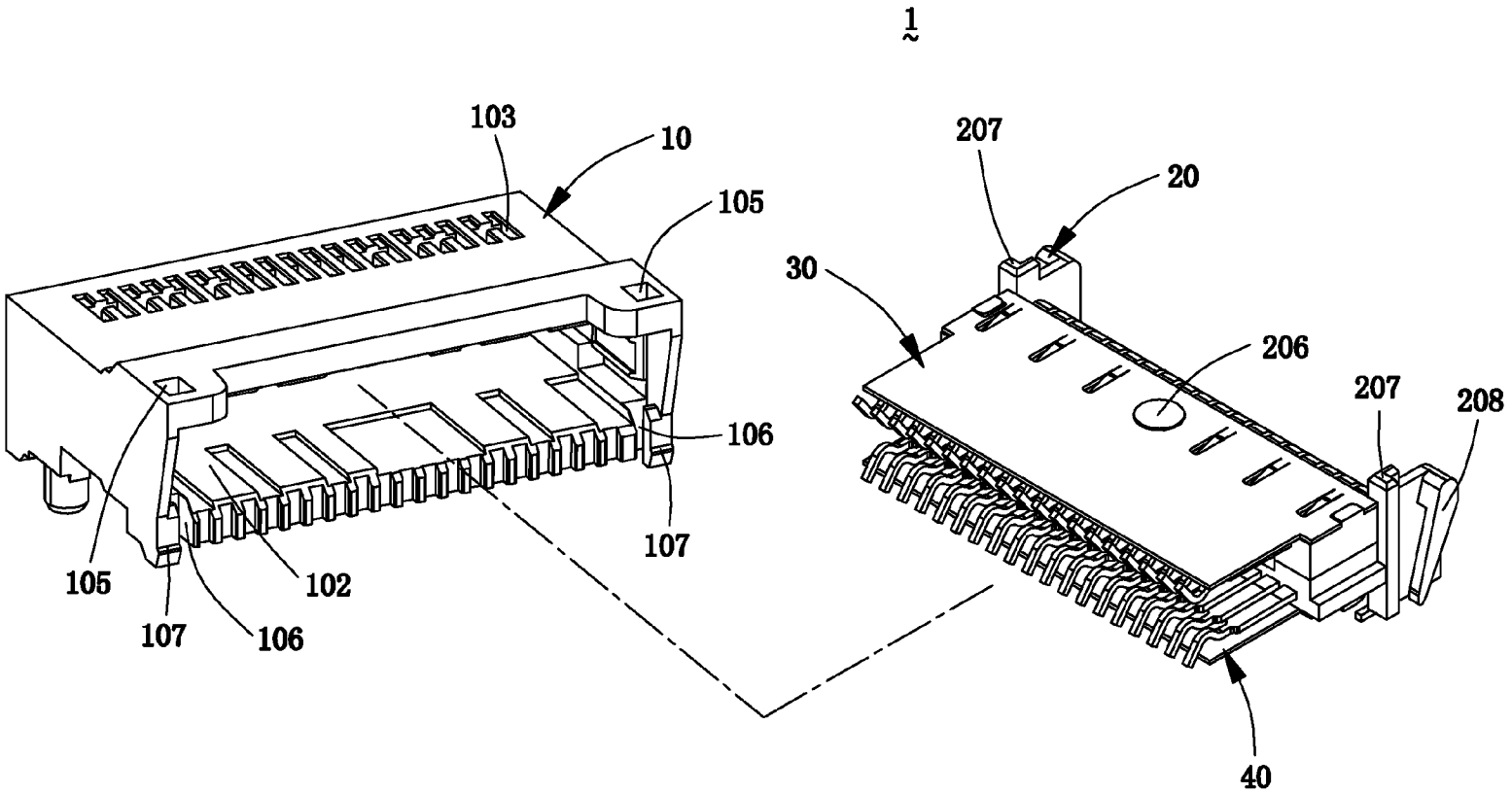
FIG. 4 is a partial exploded view of the high speed socket connector.
Figure 5:
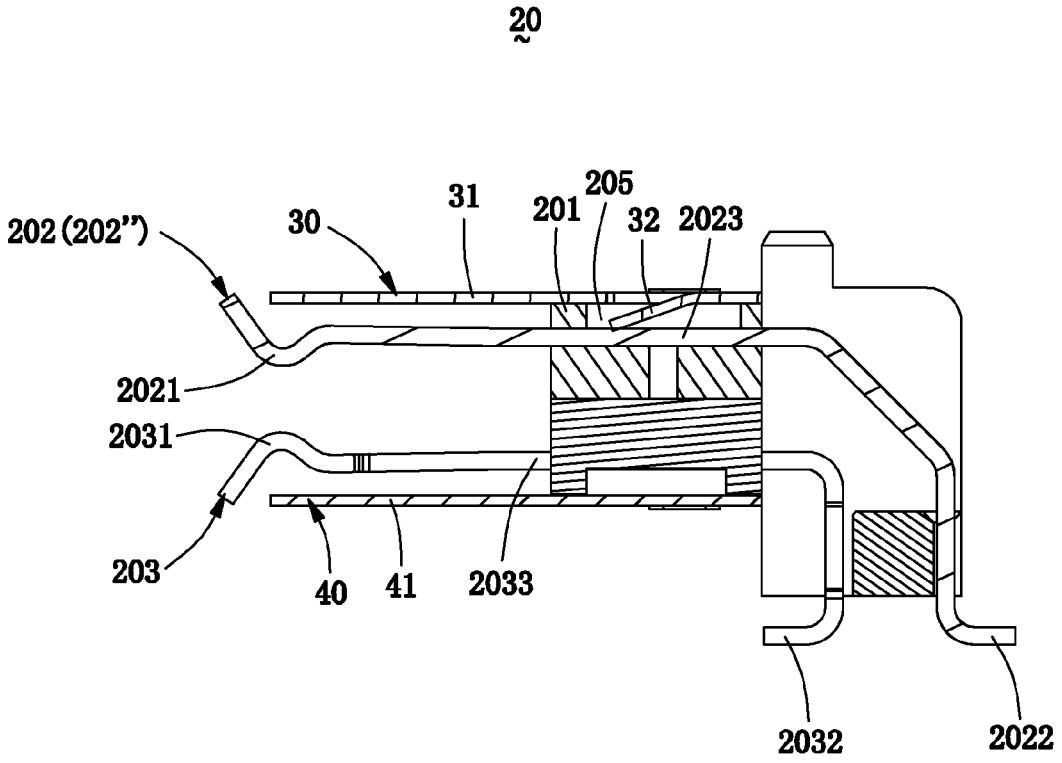
FIG. 5 is a sectional view of a terminal module shown in FIG. 4.
Figure 6:
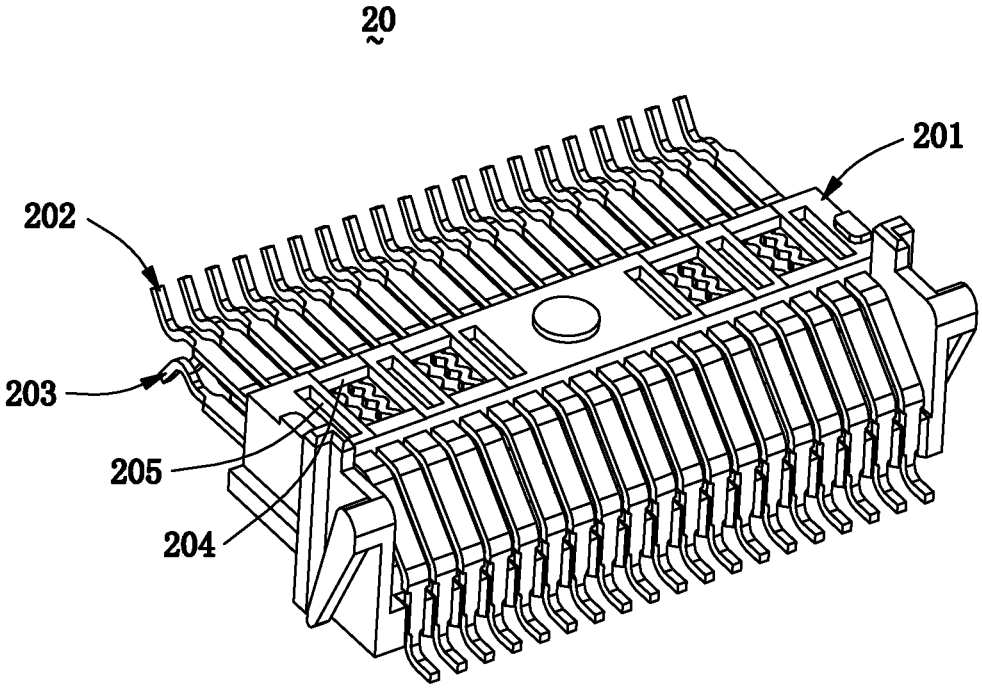
FIG. 6 is a perspective schematic view of the terminal module of the present invention.
Figure 7:
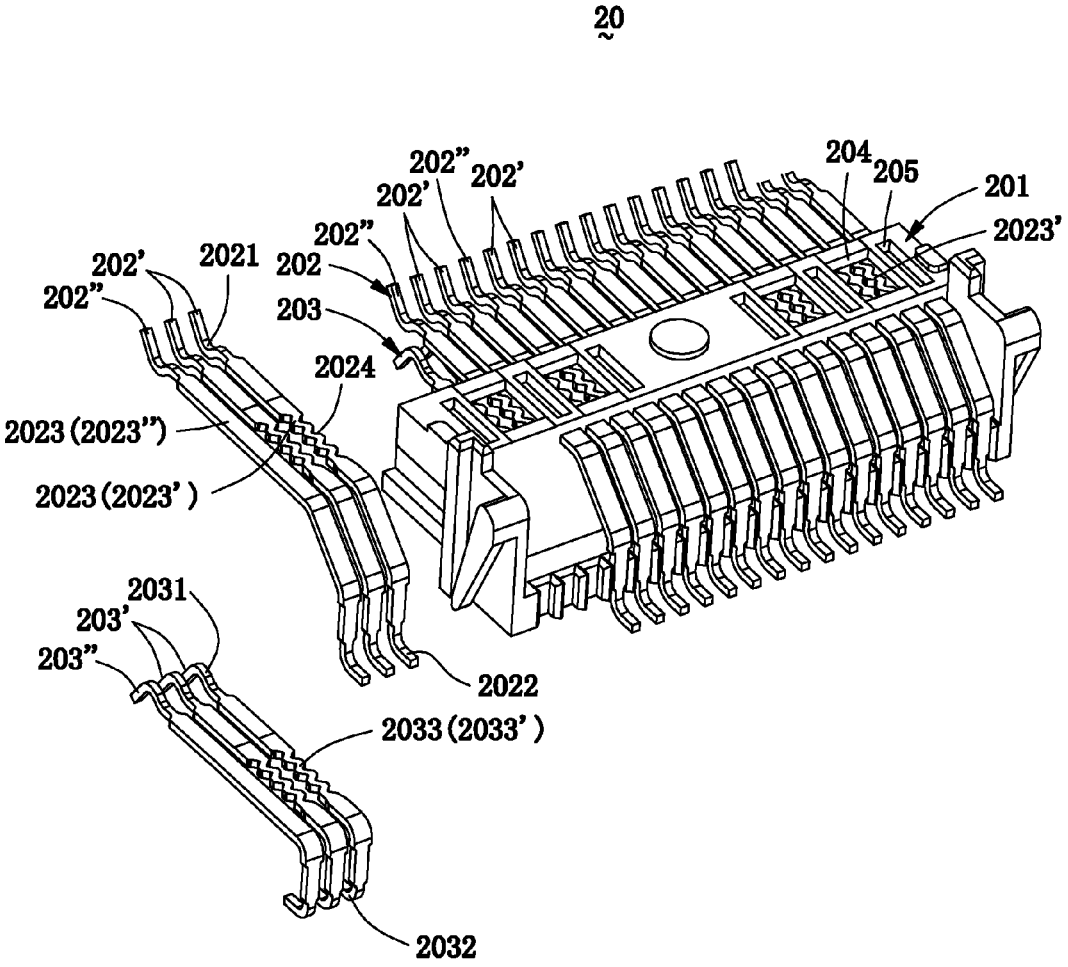
FIG. 7 is a perspective schematic view, which shows that several differential pair signal terminals and several grounding terminals are disassembled from the terminal module of FIG. 6.
Figure 8:
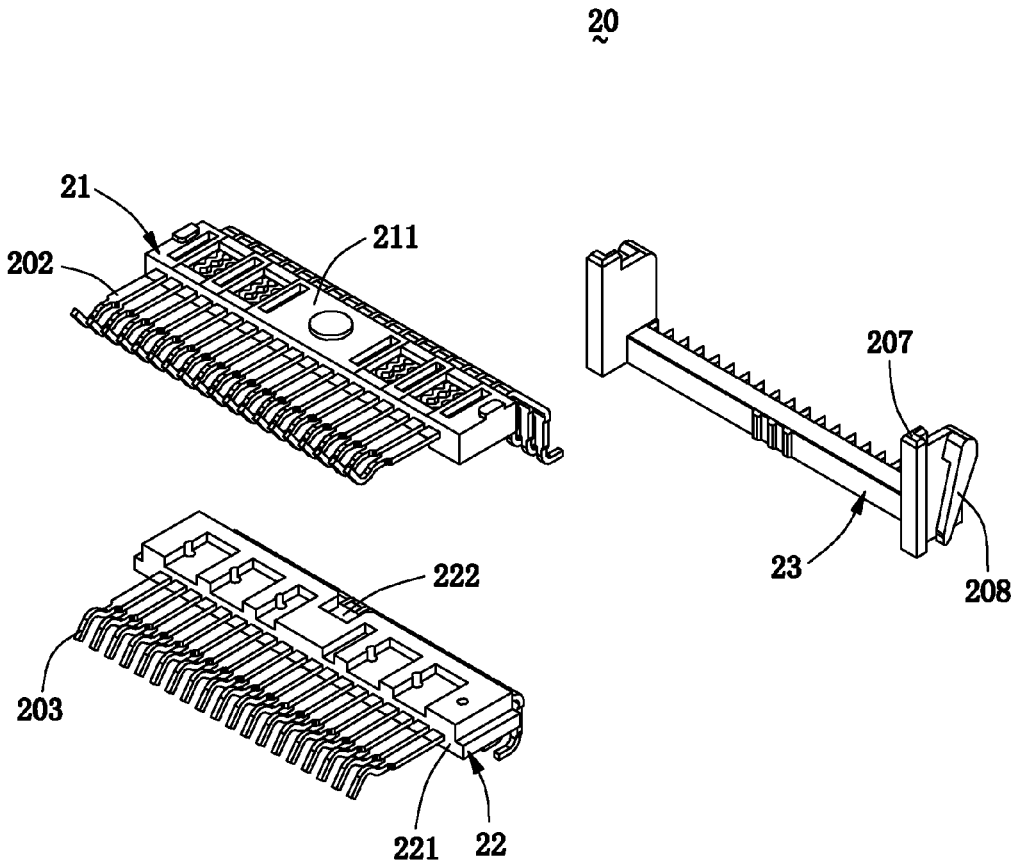
FIG. 8 is an exploded view of the terminal module shown in FIG. 3.
Figure 9:
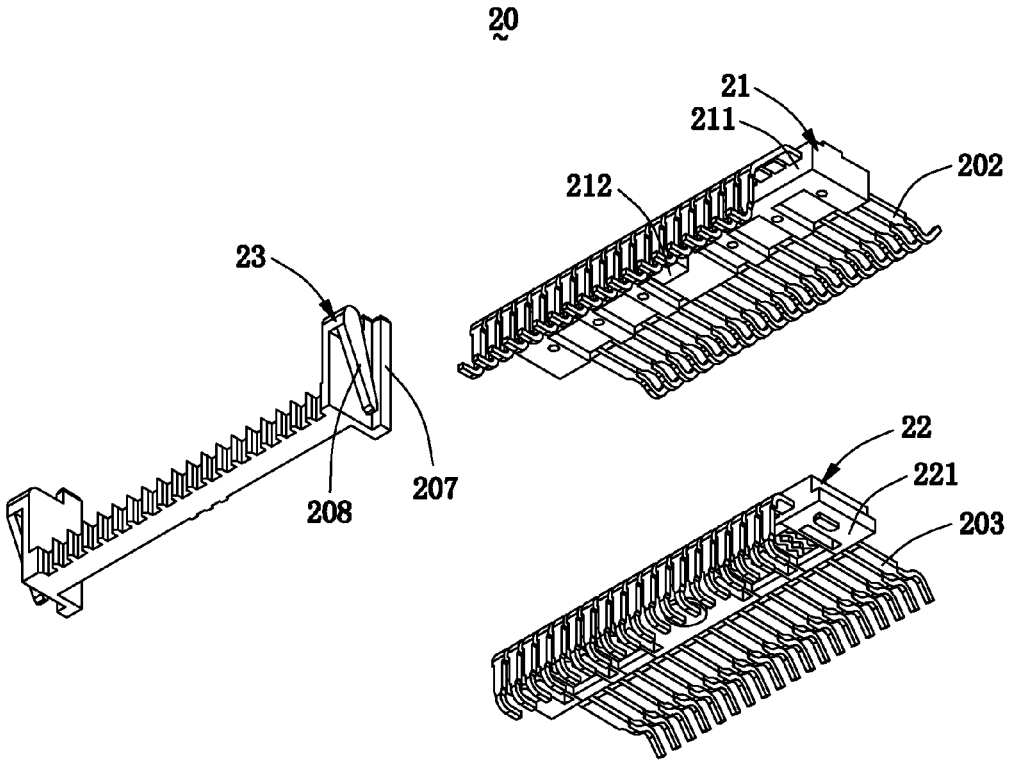
FIG. 9 is an exploded view of the terminal module along another direction.
Figure 10:
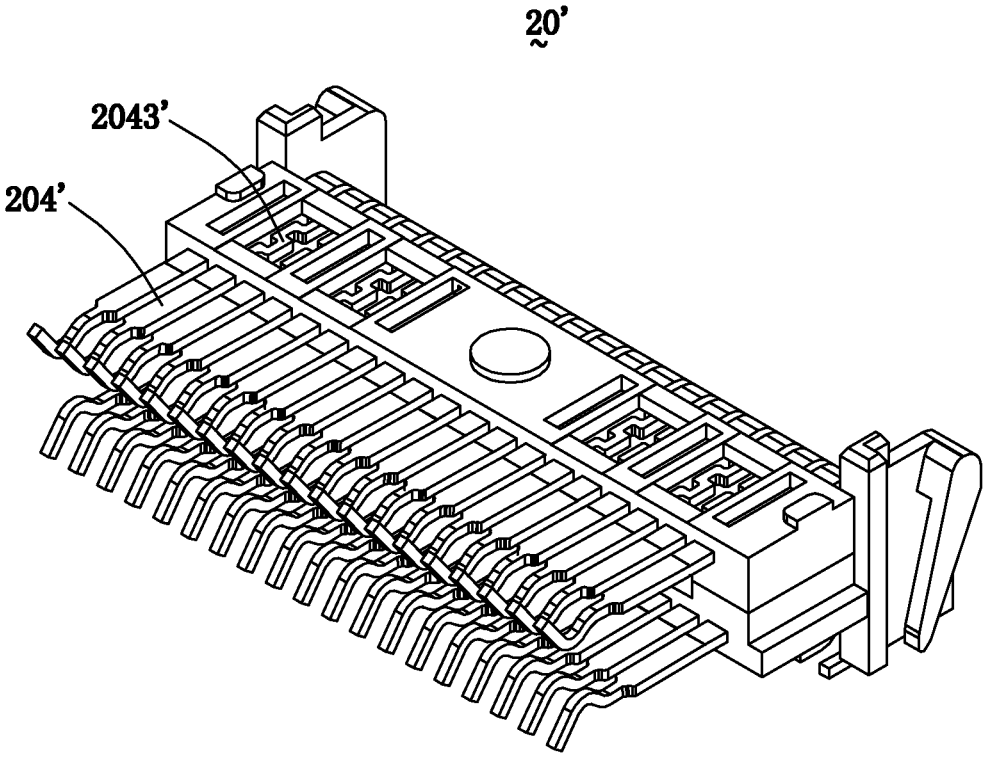
FIG. 10 is a perspective schematic view of the terminal module of another embodiment.

Please refer to FIGS. 1 to 10, FIG. 1 is a perspective schematic view of a high speed socket connector 1 of the present invention; FIG. 2 is a perspective schematic view of the high speed socket connector 1 along another direction; FIG. 3 is an exploded view of the high speed socket connector 1 shown in FIG. 1; FIG. 4 is a partial exploded view of the high speed socket connector 1; FIG. 5 is a sectional view of a terminal module 20 shown in FIG. 4; FIG. 6 is a perspective schematic view of the terminal module 20 of the present invention; FIG. 7 is a perspective schematic view, which shows that several differential pairs of signal terminals and several grounding terminals are disassembled from the terminal module 20 of FIG. 6; FIG. 8 is an exploded view of the terminal module 20 shown in FIG. 3; FIG. 9 is an exploded view of the terminal module 20 along another direction; and FIG. 10 is a perspective schematic view of the terminal module 20' of another embodiment.

Please refer to FIGS. 3 and 4, the high speed socket connector 1 of the present invention includes a case 10, a terminal mould 20, an upper shield 30 and a lower shield 40.

Please refer to FIGS. 3 and 4, the case 10 has an insertion port 101 located on the front of the case 10, a mounting port 102 located on the rear of the case 10 and being opposite to the insertion port 101, a plurality of upper terminal-receiving passages 103 formed on the top of the insertion port 101, and a plurality of lower terminal-receiving passages 104 formed on the bottom of the insertion port 101.

Please refer to FIGS. 3, 6 and 7, the terminal module 20 includes an insulative body 201, a row of upper terminals 202 located on the insulative body 201, and a row of lower terminals 203 located on the insulative body 201. The insulative body 201 forms multiple first openings 204 and multiple second openings 205 on the top and the bottom of the insulative body 201. These figures show only the first opening 204 and the second opening 205 on the top of the insulative body 201, and don't show the first opening 204 and the second opening 205 on the bottom of the insulative body 201.

Please refer to FIGS. 5 and 7, each upper terminal 202 has a mating section 2021 extending out of the front of the insulative body 201, a welding section 2022 extending out of the rear of the insulative body 201, and a retaining section 2023 located in the insulative body 201. Similarly, each lower terminal 203 has a mating section 2031 extending out of the front of the insulative body 201, a welding section 2032 extending out of the rear of the insulative body 201, and a retaining section 2033 located in the insulative body 201. The main differences between the upper terminal 202 and the lower terminal 203 are that the mating sections 2021, 2031 of the both are bent toward opposite directions (namely, an upper and lower direction), and the welding sections 2022, 2032 of the both horizontally extend along opposite directions (namely, a front and rear direction).

Please refer to FIG. 7, the row of upper terminals 202 include multiple differential pairs of signal terminals 202' and multiple grounding terminals 202" adjacent to these differential pairs of signal terminals 202'. Similarly, the row of lower terminals 203 also include multiple differential pairs of signal terminals 203' and multiple grounding terminals 203" adjacent to these differential pairs of signal terminals 203'. The labels 203', 203" also can be seen in FIG. 3.

As shown in FIG. 7, the retaining section 2023' of each signal terminal 202' of these upper terminals 202 is disposed to be a serpentine shape and is exposed in the corresponding first opening 204 of the insulative body 201. The retaining section 2023" of each grounding terminal 202" is disposed to be a straight shape and is exposed in the corresponding second opening 205 of the insulative body 201. Similarly, the retaining section 2033' of each signal terminal 203' of these lower terminals 203 is disposed to be a serpentine shape and is exposed in the corresponding first opening (not shown in FIGS) of the bottom of the insulative body. In the embodiment, the upper terminal 202 will be taken as an example to introduce the terminal structure in detail. Specifically, the width of the serpentine retaining section 2023' of the signal terminal 202' is equal to that of the straight retaining section 2023" of the grounding terminal 202", so that the distance between one differential pair of signal terminals 202' is the same as that between one signal terminal 202' and one adjacent grounding terminal 202". Thus, the high speed socket connector 1 of the present invention can balance the coupling performance of these differential pairs of signal terminals 202', 203' by disposing these first openings 204 on the insulative body 201 to expose the retaining sections 2023', 2033" of these differential pairs of signal terminals 202', 203'. Moreover, the retaining sections 2023', 2033" of these differential pairs of signal terminals 202', 203' are disposed to be a serpentine shape thereby achieving the adjustment of the impedance and filtering effect.

More specifically, in the embodiment, the upper terminal 202 will be taken as an example to further introduce the terminal structure in detail. The serpentine retaining section 2023' has multiple triangular teeth 2024 formed on two edges of the retaining section 2023'. The number of the triangular teeth 2024 can make some corresponding changes according to different terminal structures or arrangements. In other words, these triangular teeth 2024 can be closely or sparsely arranged according to the actual needs.

Please refer to FIGS. 3 and 5, the upper shield 30 has a thin plate-like main body 31 and multiple elastic fingers 32 formed on the main body 31 and bent toward the terminal mould 20. When the upper shield 30 is mounted on the top of the terminal mould 20, the front of the thin plate-like main body 31 extends above the mating sections 2021 of these upper terminals 202 to cover the row of upper terminals 202. Each elastic finger 32 enters into the corresponding second opening 205 and contacts with the corresponding grounding terminals 202" of the row of upper terminals 202, thereby forming a grounding connection. Similarly, the lower shield 40 also has a thin plate-like main body 41 and multiple elastic fingers 42 formed on the thin plate-like main body 41 and bent toward the terminal mould 20. When the lower shield 40 is mounted on the bottom of the terminal mould 20, the main body 41 covers the row of lower terminals 203, and there forms a grounding connection between each elastic finger 42 and the corresponding grounding terminals 203" of the row of lower terminals 203. Therefore, the high speed socket connector 1 of the present invention can avoid resonance by providing the upper and lower shields 30, 40 and making the upper and lower shields 30, 40 respectively contact with the grounding terminals 202", 203" of the upper and lower terminals 202, 203 to form grounding connections. In the embodiment, the widths of the main bodies 31, 41 along the direction of the left and right are generally the same as those of the row of upper terminals 202 and the row of lower terminals 203, so the upper and lower shields 30, 40 can respectively cover the upper and lower terminals 202, 203.

Moreover, as shown in FIGS. 3 and 4, the upper shield 30 is provided with a positioning hole 33. The positioning hole 33 can be engaged with a positioning protrusion 206 disposed on the top of the terminal module 20, so the upper shield 30 can be fixed on the terminal module 20. Similarly, the structures of the lower shield 40 is the same as that of the upper shield 30, no repeat is given here.

Please refer to FIGS. 3 and 4, the upper shield 30 is mounted on the top of the terminal mould 20, and the lower shield 40 is mounted on the bottom of the terminal mould 20. The terminal mould 20 together with the upper shield 30 and the lower shield 40 are inserted into the case 10 from the mounting port 102 of the case 10. These upper and lower terminals 202, 203 respectively enter into the corresponding upper and lower terminal-receiving passages 103, 104, and the mating sections 2021, 2031 are protruding into the insertion port 101 and form an elastic clamp shape for being electrically connected to plug terminals of an outer plug connector (not shown in FIGS). As shown in FIG. 2, the welding sections 2022, 2032 of these upper and lower terminals 202, 203 are arranged in side by side, and are exposed outside of the mounting port 102 of the case 10 for being mounted on one same circuit board (not shown).

Please refer to FIGS. 3 and 4, in the embodiment, in order to fix the terminal module 20, the case 10 further has two fixing holes 105 symmetrically formed on the top of the mounting port 102, two holding grooves 106 symmetrically formed on the bottom of the mounting port 102 and being respectively aligned with the two fixing holes 105, and two shoulders 107 symmetrically formed on the rear of the mounting port 102. The terminal module 20 is provided with two upright fixing posts 207 located on two sides thereof, and two fixing arms 208 adjacent to the two fixing posts 207. When the terminal module 20 is mounted on the case 10, the top of the fixing post 207 is inserted into the corresponding fixing hole 105, the bottom of the fixing post 207 is held by the corresponding holding groove 106, and the bottom of the fixing arm 208 stands on the corresponding shoulder 107. According to these matching structures, the terminal module 20 is fixed in the case 10.

Please refer to FIGS. 8 and 9, in the embodiment, the terminal module 20 includes an upper module 21, a lower module 22 and a holder 23. The upper module 21 includes an upper insulative body 211 and these upper terminals 202 formed on the upper insulative body 211. The lower module 22 includes a lower insulative body 221 and these lower terminals 203 formed on the lower insulative body 221. The two fixing posts 207 and the two fixing arms 208 are formed on the holder 23. In other words, the aforementioned insulative body 201 (seen in FIG. 3) consists of the upper insulative body 211, the lower insulative body 221 and the holder 23. In the embodiment, the upper insulative body 211 and these upper terminals 202 are insert-molded to form the upper module 21, and the lower insulative body 221 and these lower terminals 203 are also insert-molded to form the lower module 22.

Please refer to FIGS. 8 and 9, in the embodiment, the upper module 21 has a protruding block 212 on the bottom thereof, and the lower module 22 has a recess 222 on the top thereof. The upper module 21 and the lower module 22 can be initially positioned together by the engaging of the protruding block 212 and the recess 222, then they can be together mounted into the case 10 of FIG. 4. Finally, the holder 23 is mounted and fixed on the rear of the case 10 of FIG. 4 from down to up, and can prevent the terminal module 20 from getting out of the case 10.

As shown in FIG. 10, in the other embodiment, the retaining section 2043' of each differential pair of signal terminals 204' of the terminal module 20' of the present invention is disposed to be a square saw-tooth shape thereby achieving the adjustment of the impedance and filtering effect.

As described above, the high speed socket connector 1 of the present invention can realize a good shielding effect by the connection of the upper and lower shields 30, 40 and the grounding terminals 202", 203". Moreover, the insulative body 201 is provided with these first openings 204 for exposing the retaining sections 2023', 2033' of these differential pair of signal terminals 202', 203', thereby balancing the coupling performance of these differential pairs of signal terminals 202', 203'. Furthermore, the retaining sections 2023', 2033' of these differential pairs of signal terminals 202', 203' are disposed to be a serpentine shape thereby achieving the adjustment of the impedance and filtering effect.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A high speed socket connector comprising:

a case having an insertion port located on the front of the case, and a mounting port located on the rear of the case and being opposite to the insertion port;

a terminal module being mounted into the case from the insertion port; the terminal module including an insulative body, a row of upper terminals formed on the insulative body, and a row of lower terminals formed on the insulative body; the insulative body forming multiple first openings and multiple second openings; each of the upper and lower terminals having a mating section extending out of the front of the insulative body and entering into the insertion port, a welding section extending out of the rear of the insulative body and being exposed outside of the mounting port, and a retaining section located in the insulative body; these upper and lower terminals including multiple differential pairs of signal terminals and multiple grounding terminals adjacent to these signal terminals; the retaining section of each signal terminal being disposed to be a serpentine shape and being exposed in the corresponding first opening; and the retaining section of each grounding terminal being disposed to be a straight shape and being exposed in the corresponding second opening;

an upper shield being mounted on the top of the terminal mould; and a lower shield being mounted on the bottom of the terminal mould;

wherein the case further has two fixing holes symmetrically formed on the top of the mounting port, two holding grooves symmetrically formed on the bottom of the mounting port and being respectively aligned with the two fixing holes, and two shoulders symmetrically formed on the rear of the mounting port;

the terminal module disposing two upright fixing posts and two fixing arms adjacent to the two fixing posts; the top of each fixing post being inserted into the corresponding fixing hole, the bottom of each fixing post being held by the corresponding holding groove, and the bottom of each fixing arm standing on the corresponding shoulder.

2. The high speed socket connector as claimed in claim 1, wherein the width of the serpentine retaining section of the signal terminal is equal to that of the straight retaining section of the grounding terminal; and the serpentine retaining section has multiple triangular teeth formed on two edges of the retaining section.

3. The high speed socket connector as claimed in claim 1, wherein each of the upper and lower shields has a thin plate-like main body and multiple elastic fingers formed on the main body and bent toward the terminal mould; the front of the main body of the upper shield extends above the mating sections of these upper terminals to cover the row of upper terminals, and each elastic finger of the upper shield enters into the corresponding second opening and contacts with the corresponding grounding terminals of the row of upper terminals to form a grounding connection; the front of the main body of the lower shield extends under the mating sections of these lower terminals to cover the row of lower terminals, and each elastic finger of the lower shield enters into the corresponding second opening and contacts with the corresponding grounding terminals of the row of lower terminals to form a grounding connection.

4. The high speed socket connector as claimed in claim 3, wherein the terminal module is provided with two positioning protrusions respectively formed on the top and the bottom of the terminal module; each of the upper and lower shields is provided with a positioning hole on the main body to be engaged with the corresponding positioning protrusion.

5. The high speed socket connector as claimed in claim 1, wherein the terminal module includes an upper module, a lower module and a holder; the upper module includes an upper insulative body, and these upper terminals are formed on the upper insulative body; the lower module includes a lower insulative body, and these lower terminals are formed on the upper insulative body; the two fixing posts and the two fixing arms are formed on the holder; and the insulative body consists of the upper insulative body, the lower insulative body and the holder.

6. The high speed socket connector as claimed in claim 5, wherein the upper module has a protruding block on the bottom of the upper module, and the lower module has a recess on the top of the lower module; the upper module and the lower module is initially positioned together by the engaging of the protruding block and the recess.

7. The high speed socket connector as claimed in claim 1, wherein the case further has a plurality of upper terminal-receiving passages formed on the top of the insertion port, and a plurality of lower terminal-receiving passages formed on the bottom of the insertion port; these upper and lower terminals respectively enter into the corresponding upper and lower terminal-receiving passages.

8. A high speed socket connector comprising:

a case having an insertion port located on the front of the case, and a mounting port located on the rear of the case and being opposite to the insertion port;

a terminal module being mounted into the case from the insertion port; the terminal module including an insulative body, a row of upper terminals formed on the insulative body, and a row of lower terminals formed on the insulative body; the insulative body forming multiple first openings and multiple second openings; each of the upper and lower terminals having a mating section extending out of the front of the insulative body and entering into the insertion port, a welding section extending out of the rear of the insulative body and being exposed outside of the mounting port, and a retaining section located in the insulative body; these upper and lower terminals including multiple differential pairs of signal terminals and multiple grounding terminals adjacent to these signal terminals; the retaining section of each signal terminal being exposed in the corresponding first opening; and the retaining section of each grounding terminal being exposed in the corresponding second opening;

an upper shield being mounted on the top of the terminal mould; and a lower shield being mounted on the bottom of the terminal mould;

wherein each of the upper and lower shields has a thin plate-like main body and multiple elastic fingers formed on the main body and bent toward the terminal mould; the front of the main body of the upper shield extending above the mating sections of these upper terminals to cover the row of upper terminals, and each elastic finger of the upper shield entering into the corresponding second opening and contacts with the corresponding grounding terminals of the row of upper terminals to form a grounding connection; the front of the main body of the lower shield extending under the mating sections of these lower terminals to cover the row of lower terminals, and each elastic finger of the lower shield entering into the corresponding second opening and contacts with the corresponding grounding terminals of the row of lower terminals to form a grounding connection.

9. The high speed socket connector as claimed in claim 8, wherein the retaining section of each signal terminal is disposed to be a serpentine shape or a square saw-tooth shape.

* * * * *